US006623209B1

(12) United States Patent
Waters, Jr.

(10) Patent No.: US 6,623,209 B1
(45) Date of Patent: Sep. 23, 2003

(54) AUTOMATIC FLOOD GATE

(75) Inventor: Louis A. Waters, Jr., Bellaire, TX (US)

(73) Assignee: Floodbreak LLC, Houston, TX (US)

( * ) Notice: Subject to any disclaimer, the term of this patent is extended or adjusted under 35 U.S.C. 154(b) by 0 days.

(21) Appl. No.: 10/116,249

(22) Filed: Apr. 4, 2002

(51) Int. Cl.[7] ..... E02B 7/40
(52) U.S. Cl. ..... 405/94; 405/100
(58) Field of Search ..... 405/94, 93, 92, 405/99, 100, 87, 107, 110

(56) References Cited

U.S. PATENT DOCUMENTS

| | | | |
|---|---|---|---|
| 4,355,000 | A | 10/1982 | Lumelleau |
| 4,377,352 | A | 3/1983 | Goodstein |
| 4,582,451 | A | 4/1986 | Hollander, Jr. |
| 4,881,854 | A | 11/1989 | Bowe |
| 5,283,979 | A | 2/1994 | Carlson et al. |
| 5,460,462 | A | 10/1995 | Regan |
| 5,943,832 | A | 8/1999 | Russell |
| 6,425,707 | B1 * | 7/2002 | Baxter ..... 405/87 |

OTHER PUBLICATIONS

Presray Web Site Flood Gate FB55 http://www.presray.com/flood_protection_site/fb55/fb55_p6.htm.

* cited by examiner

*Primary Examiner*—Heather Shackelford
*Assistant Examiner*—Lisa M Saldano
(74) *Attorney, Agent, or Firm*—Tim L. Burgess

(57) ABSTRACT

A horizontally pivoted structurally rigid buoyant flood gate, in a housing for the gate arranged in front of an opening to a construction, is pivotally floated out of the housing by rising water entering a portal to the housing, and rotates buoyantly upward toward the opening, rising between two side walls longitudinal to the opening and separated from each other by little more than the side-to-side distance of the gate, allowing little water through any gap separating the gate from the side walls, which preferably is sealed by a compression seal, the hydrostatic pressure of water dammed behind the rising gate urging completed closure of the gate through at least the upper half of the closing arc, pressing the gate sealingly against the jambs.

38 Claims, 6 Drawing Sheets

AUTOMATIC FLOOD GATE

BACKGROUND OF THE INVENTION

This invention generally relates to method and apparatus for regulating the flow of water, more particularly, to water gates, and especially water gates in which the water gate turns about a pivot axis which is generally parallel to the horizon.

Major flooding too often happens in urban areas when runoff of surface water from sustained and heavy rains, or stream overflow, or cresting or penetration of water retention dikes, overwhelms water drainage and removal systems. At high risk in any such situation are buildings with subterranean areas including basements, subterranean tunnels and halls, parking garages and the like. Surface water invading through open entries of the buildings runs to lower levels. As lower levels fill, flooding can climb to higher subterranean floors and to adjacent buildings if buildings are connected by underground pedestrian or utility tunnels. If standby power generators and/or fuel powered water evacuation pumps are located below surface grade, such as in a basement, as all too often is the case, the power generators and water pumps can be disabled by water flooding into an area where they are located, removing often the last line of flood defense of the building.

Openings to buildings through which rising water can invade include entrances to covered receiving and loading docks, to underground parking areas and garages, to descending stairwells, and to vents, and potential entrances include grade-level and below grade windows or doors. Bottom-hinged "flip-up" flood gates, with inflatable gaskets, that are floor recessed when not in use, that have an exposed surface for traffic passage, and that are raised by hydraulic cylinders or winches, are commercially available. Other also not automatic building water barriers are shown in U.S. Pat. No. 5,943,832 for flood or storm resistant barriers for doorways or window opening; U.S. Pat. No. 5,283,979 for locking/opening system for watertight hatch, U.S. Pat. No. 4,582,451 for floodgate panel and sealing means therefor; and U.S. Pat. No. 4,355,000 for lightweight, removable gate seal.

Storms that produce locally heavy flooding occur only sporadically, so available flood gates of the art as described above remain in a retracted position for long periods of time. Because these flood gates are not automatic, on-site or on-call personnel are required to put them into barrier position when a high water inundation event is anticipated. When the event is a cresting river or the like, there is some advance notice. Unfortunately, nature sometimes comes calling torrentially, unexpectedly and inconveniently, when personnel are not on site, such as the middle of the night, and even if on-call, the personnel may be prevented by flooding of roadways from getting to the site in time to erect the flood gates before the structure meant to be protected is already inundated.

There have been efforts to automate erection of flood gates. One such example is U.S. Pat. No. 5,460,462, in which a vertically disposed flotation barrier elevates on guide tracks between channel posts when water rises within a vertical subterranean housing containing the flotation barrier. There are disadvantages, however, to such a vertical barrier. Hydrostatic forces generated by rising surface water press the barrier against its tracks, increasing friction and causing the barrier to resist the buoyancy forces working to raise the barrier vertically. Installation of the vertically disposed buoyant barrier requires evacuation of ground for the supporting structure to depth greater than the full height the barrier. Particularly in existing constructions such as parking garages and tunnels, the building structure itself or buried ancillary structure prevents excavations to a depth needed for placement of a vertical barrier. In addition, when a flood recedes, mud and flood debris from the water remain, and removal of debris from a tall, thin vertical slot in the ground, occluded with the flotation barrier, presents maintenance difficulties.

U.S. Pat. No. 4,377,352, issued Mar. 22, 1983 to Goodstein, describes a self-actuating water containment barrier for guarding open fields along flooding streams or rising lakes. The barrier comprises a plurality of stanchions which are mounted for pivotal movement from a normal dormant horizontal position, to an active vertical position. The stanchions are interconnected with water barrier-forming sheeting to form a barrier which can conform to a particular land mass or shoreline. Float members are mounted on the bottom of the outer ends of the stanchions. At low water levels, the float members rest on a shallow body of water or on the ground in a near horizontal position. As the level of the water rises, the float members cause the adjacent stanchions to pivot into a vertical position, thereby raising the sheeting between them to form a water barrier. This water barrier float system is unsuitable for guarding openings to constructions where cars or human beings must normally pass over the apparatus involved during the long times when the apparatus is retracted at rest.

SUMMARY OF THE INVENTION

This invention provides a flood guard method and apparatus for automatically refusing admission of rising surface water into a structural opening of a construction. By "construction" is meant any structure, building, erection, edifice or the like, and includes interior and exterior partitions and walls, in which openings such as doors or windows may occur, for passage from outside the construction to its interior, or within the construction from one room to another, or from one side of a partition to the other side, and this includes elongated passages such as tunnels and halls. The construction and the opening in the construction may be at ground level or below ground level, such as an underground parking garage, a basement, a subterranean tunnel or other subterranean space, so long as access to the construction or from one part of the construction to another is by an opening through which water can flow under the force of gravity. The essential factor is that the invention guards against flooding from surface water through an opening to the construction.

In general, the invention involves (i) pivoting a buoyant and structurally rigid flood gate from adjacent grade about an axis at the base of the gate arranged adjacent the bottom of a construction opening generally parallel to grade, such that, on rise of surface water sufficient to float the gate, the gate is buoyed and by force of rising water is rotated about the pivot axis in the direction of the opening, and (ii) as the gate buoyantly rotates upwardly, preventing the rising water from flowing around the sides of the gate sufficiently that enough hydraulic pressure is impressed on the gate by the rising water to push the gate into closing contact with stops or jambs adjacent the sides of the opening, thereby closing the opening and barring admission of flood water into the construction. The combination of an initial buoyant rotation of the gate upwardly about a horizontal axis followed by hydraulic force from water accumulated against the back of the up-rotated gate completes closure of the opening (with closure maintained by impress of hydraulic pressure). With a buoyant flood gate reposed at grade, the buoyant action of the gate in response to rising surface water is a rotational closing force for less than half the closing movement, when hydraulic pressure forces from water accumulating on the water side of the gate take over and complete the closing movement. Gate buoyancy, dependant on a variety of factors, including amount and kind of buoyant material, weight, and height verses width of the gate, affects the relative degree to which buoyancy closing forces surrender primacy to hydrostatic closing forces in a particular design.

Thus this invention provides a method for automatically refusing admission of rising surface water into a structural opening of a construction, the opening having opening-limiting margins, including a bottom, sides and usually a top. The method comprises (a) housing a buoyant gate of dimension occlusive to at least a lower portion of the opening adjacently in front of the opening, substantially parallel to grade, pivotingly arranged about a pivot axis parallel to the bottom of the opening and in a recess into which surface water can flow, (b) providing a portal for admitting surface water into the recess to cause the gate to pivotingly buoy upwardly from the recess in a rotation closing towards the opening, and (c) preventing rising surface water from flowing around sides of the upwardly buoyed gate, whereby rising surface water accumulates behind the gate and hydraulic pressure of the rising surface water exerts a continuing closing force rotating the gate toward, thence occlusively across, at least a lower portion of the opening.

Apparatus is provided in accordance with the invention to perform the function of the invention. A self actuating flood guard for refusing admission of rising surface water into a structural opening of a construction, the opening having opening-limiting margins, including a bottom, sides and usually a top, comprises (1) a buoyant gate having a base, sides, a front, a back and dimensions occlusive of at least a lower portion of the opening, the base being arranged for location adjacent the bottom of the opening, (2) pivotation members hinging the gate at the base about a pivot axis parallel to the bottom of the opening and allowing the gate to rest substantially parallel and adjacent grade proximately in front of the opening for pivotation upwardly toward and transversely to the opening, (3) a pair of upright walls reaching from grade and extending alongside the sides of the gate at rest, the walls having facing surfaces spaced apart sufficiently to allow the gate to pivot upwardly between them toward the opening with the sides of the gate close enough to the facing wall surfaces to permit hydrostatic pressure of surface water rising from the grade to develop against the back of the gate effective to impart a closing force on the gate after the gate buoyantly has pivoted from rest upwardly about the axis, and (4) jambs adjacent the sides of the opening for confronting and stopping rotation of the gate about the axis when the gate is rotated a predetermined extent under the closing force of the rising water hydrostatic pressure, thereby putting the gate in a closed position refusing admission of rising water into at least a lower portion of the opening. The predetermined extent suitably but not necessarily is an extent that places the jambs substantially upright but not in excess of 90 degrees relative to the grade.

The flood guard advantageously comprises a housing for the gate and pivotation members, the housing including a floor and sides for containing the gate above the floor such that with the gate resident in the housing the front of the gate substantially closes the gate housing. In many applications the gate is weight bearing, and when resident in the housing, it provides a passageway for traffic into the construction through the opening.

The gate housing further comprises a surface water portal into the housing giving access to the floor of the housing when the gate is resident in the housing, the housing and gate being configured to permit surface water entering through the portal to rise beneath the gate and pivotingly buoy the gate upwardly from the housing for rotation about the axis toward the opening. Optionally the portal is located in the housing at least adjacent the location in the housing remote from where the base of the gate is pivoted.

A drain is provided in the gate housing to remove waters flowing into the housing. Typically the removed water is emptied to a storm water collector tributary such as storm sewer, ditch, canal or other water collecting and removal system, including return to streets to discharge from the street to ditches or to storm sewers accessed by inlets along the sides of the streets. The purpose of the drain is to prevent the gate from floating up and out of its housing on the occasion of a heavy downpour which has not become a flooding situation. So long as the storm sewer or other water collector system is not full, water will not back up in the drain but will flow out and be removed by the water collector system. But in a condition where storm sewers are full and flowing at maximum rate, a limiting condition has been reached; street water no is longer accepted in the storm sewer, piles up, spreads and rises. This is the situation where the gate self-actuates, because the gate housing drain can no longer discharge its received water, and water entering the housing portal rises, elevating the gate. Thus the gate does not elevate during a mere heavy downpour but only when there is rising surface water in a flooding condition.

Seals affixed to the sides of the gate sealingly closing the gaps between the sides of the gate and the facing wall surfaces during rotation of the gate toward the opening of the construction. Suitably the seals are contact seals, preferably of a type that compress when brought into engagement with the walls during rotation toward the opening.

In one embodiment the jambs are affixed to the upright walls adjacent the opening and reach upwardly from adjacent grade. The jambs may reach an elevation proximate the height of the upright walls adjacent the opening, and may and preferably do include a resilient sealing surface arranged to cooperate with facing surfaces of the front of the gate in the closed position to seal against admission of water between the jamb and the gate.

The gate comprises buoyant material, for example, it may comprise a plurality of sealed tubes arranged side by side, or a honeycomb core structure sealingly arranged between two rigid panels. Alternatively the gate may have a bladder for a flotation material.

While the rotation of the gate about a pivot axis parallel to the bottom of the opening to be protected describes an arc, the rise of surface water is planar to horizontal, so more than a right angular shape of the upright walls between which the gate rotates upwardly is surplus structure, although structure may be provided above the hypotenuse to the right angle triangle for appearance or architecturally pleasing reasons. The walls are, of course, water impervious.

The jambs may be affixed to the construction on the sides of the opening. Alternatively the jambs may be freestanding from grade level or may project toward the opening from the upright walls, but the jambs are always spaced apart not more than the spacing of facing surfaces of the walls. Where the jambs are freestanding, the jambs are arranged with respect to the construction to act as a barrage to water between the jambs and the construction. Where the jambs are part of the walls, the walls are arranged relative to the construction to form a barrage to water between the walls and the construction. In an application of the invention, the upright walls extend from the construction and in cooperation with the jambs and the gate in the closed position provide a barrage to water between the walls and the construction.

The invention works either where the grade on which it is installed is horizontal or is angled relative to horizontal, either declined or inclined. Thus the construction may be a parking garage with underground parking accessed by a downwardly sloped ramp in which the flood guard may be installed.

The system of the invention is completely passive and automatic. There is no power or maintenance requirement and the gate normally rests out of the way so that once it is installed, most people passing or driving over it don't even realize it is there. The method and apparatus of this invention have advantages over a vertical rising gate such as disclosed in U.S. Pat. No. 5,460,462, described above. For one thing, hydrostatic pressure of the rising water works to the advantage of the flood gate system of this invention, rather than against it. As mentioned, in the buoyant vertically rising barrier, any forces generated by dammed water to one side of the barrier serve to press the barrier against its tracks, increasing friction and making the barrier more resistant to floating upwards to full elevation. In the instant invention, the water pressure actually pushes the gate into fully elevated position. The gate will fully close when the water reaches between about one-third to about one-half, e.g., about 35–45%, of the overall height of a normally horizontally retracted gate.

Further, installation of the barrier is vastly simplified due to its horizontal packaging. The buoyant gate and its housing can be as little as only about four inches in height, whereas a buoyant vertically rising barrier must be the installed to a depth equal to the full height of the barrier plus some additions for structural support. Installation in roadways, and particularly in parking garages or tunnel systems, where other structures may lie closely beneath, is made possible by the present invention due to the minimized need to excavate material. Actually the design of this invention can be installed without any digging at all where necessary; it can be installed on top of the approach surface to the construction opening and would look like a flat speed bump lying on the surface of the pavement.

Also, maintenance of the flood gate of the instant invention is greatly eased due to its horizontal nature. In the case of a flood, mud, debris, and other detritus is carried in the water. When the flood recedes, much of this material will fall out of the water and remain behind. Cleaning the flood gate of the instant invention will require the washing of a broad, flat pan compared to cleaning a tall, thin slot in the ground.

These and other advantages of the instant invention will become more apparent to those in the art from the description of an embodiment which follows after an identification of the drawings used in connection with the description.

DETAILED DESCRIPTION OF EMBODIMENT OF THE INVENTION

Figure 1:
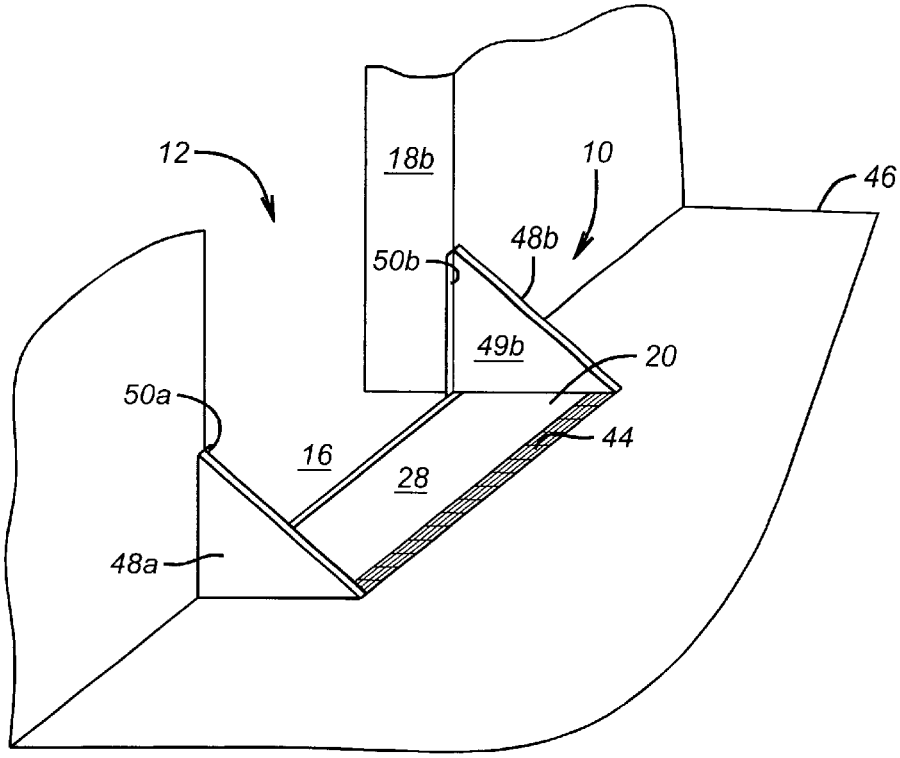
FIG. 1 is an isometric schematic view of a flood guard embodiment of this invention showing a flood gate in retracted position.
Figure 2:
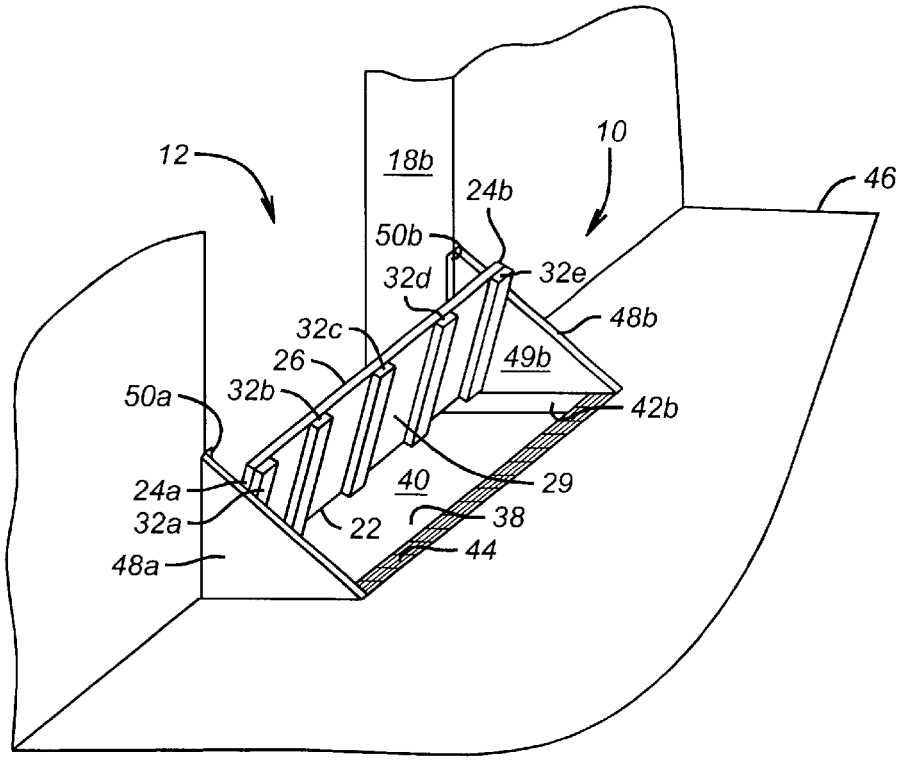
FIG. 2 is the same view as FIG. 1 but showing a flood gate rising toward a closing position.

Referring to the drawings, reference numeral 10 designates a self actuating flood guard system 10 for refusing admission of rising surface water into a structural opening 12 of a construction 14. The opening 12 has a bottom 16 and sides 18*a* and 18*b*. The system 10 comprises a buoyant gate 20 having a base 22, sides 24*a* and 24*b*, top 26, a front 28, a back 29 and dimensions occlusive of at least a lower portion of opening 12. Gate base 22 is arranged for location adjacent the bottom 16 opening 12. As shown in FIGS. 1 and 2, gate 20 comprises a weight bearing flat structure over which pedestrian, automobile or other traffic may travel when passing through opening 12 under non flooding conditions.

Figure 3:
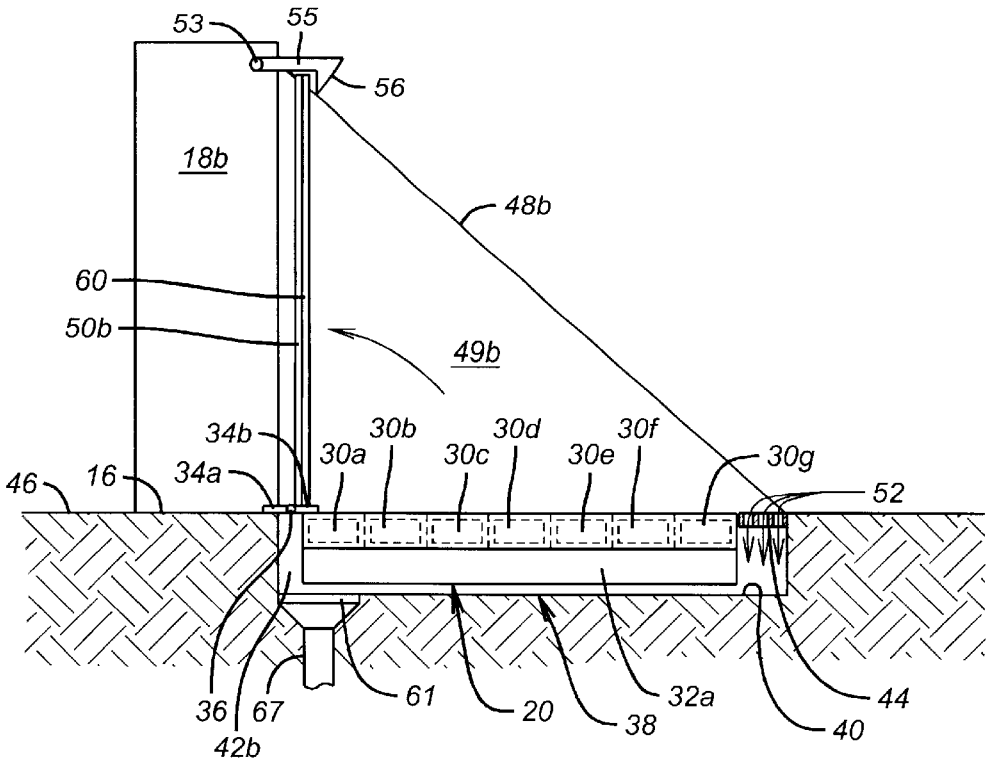
FIG. 3 is a schematic sectional side view of a flood guard showing a flood gate resident in a flood guard housing installed in front of an opening.
Figure 4:
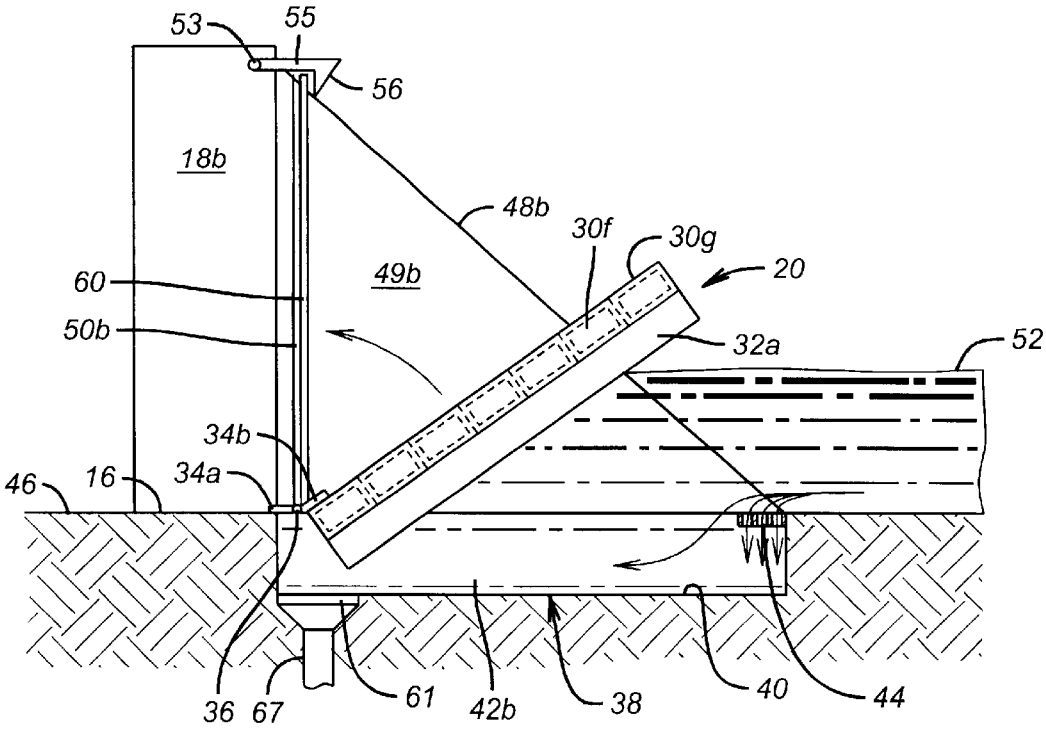
FIG. 4 is the same view as FIG. 3 schematically showing buoying rotation of the flood gate out of the gate housing.
Figure 5:
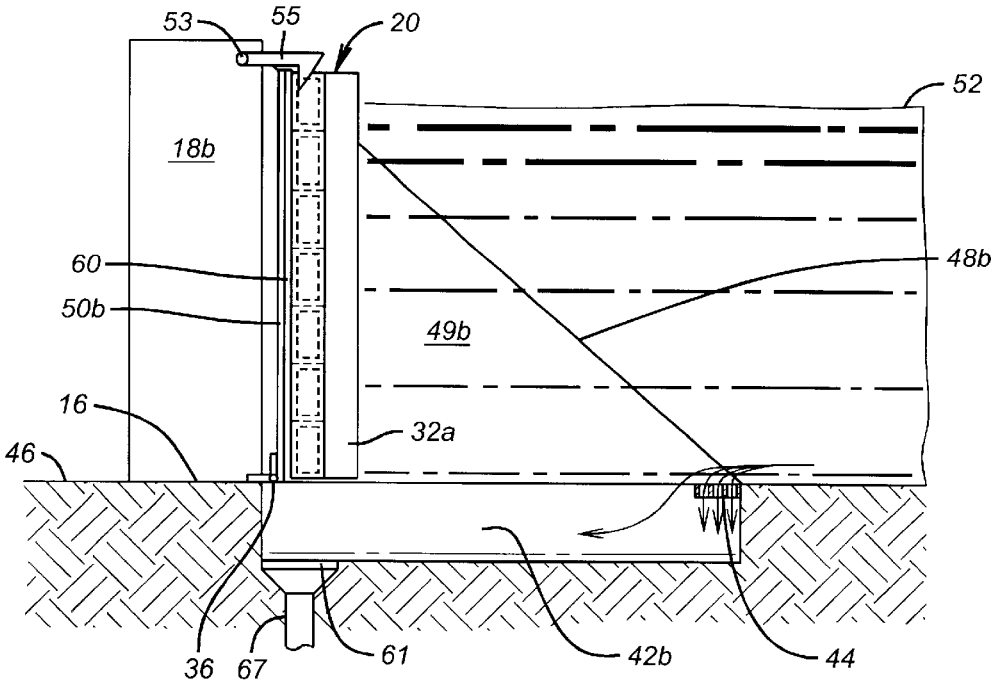
FIG. 5 is the same view as FIGS. 3 and 4 and schematically shows the flood gate rotated to a closed position by hydraulic force of accumulated water restrained behind the gate.

Gate 20 includes a flotation material and suitably comprises buoyant material providing a rigid upper surface for traffic, such as, referring to FIGS. 3–5, a plurality of sealed structural aluminum tubes 30*a*–30*g*, arranged side by side. As seen in FIGS. 2–5, 7 and 11, a plurality of support members 32*a*–32*f* are transversely affixed to tubes 30*a*–30*g* (about which, more below). For specific example, for a 12 foot wide garage entrance, the gate may be constructed of 12 feet lengths of 2×5 inch structural aluminum tubing 30 having a ⅛ wall arranged and secured side by side to provide a flotation member 30 inches tall capable of bearing traffic. Support members 32 suitably would be 30 inches long on centers determined by the number of supports (e.g., 17 inch centers in the case of 14 supports for a 12 feet wide gate). Alternatively the flotation material may comprise a honeycomb core structure sealingly arranged between two rigid panels, or a sealed gas bladder surmounted by a structural aluminum panel. In the case of a composite structure of a honeycomb core material sandwiched vertically between horizontal skins of aluminum or other high strength composite material, a bonding material is used to attach the skin material to the honeycomb core. Such a honeycomb panel is used, for example, in the floor panels of most airliners and offers a high strength to weight material, and can be corrosion and fungi resistant. Honeycomb panels of this general type are manufactured, for example, by Hexcel Corporation, Stamford, Connecticut; Plascore Inc., Zeeland, Mich. M. C. Gill Corporation, El Monte, Calif. and others. For an eight feet wide entrance to a parking garage, the panel suitably would be about 8 and ½ feet wide and 2 inches thick with a honeycomb density suitably in the range of about 4–8 pounds per cubic foot (pcf) contained with a framework of 2 inch diameter, 0.125 inch wall thickness square tubing, and bonded to face skins of 3/16 inch sheeting. Alternatively, the gate may comprise a sandwich in which the center is a crush proof buoyant closed cell foam polyurethane form or other satisfactory material within the skill of the art to employ.

Pivotation members 33 comprising a hinge plate 34 (34*a*, 34*b*) and pin 36 assembly (see FIGS. 3–6) hinge gate 20 at base 22 about a pivot axis co-incident with pin 36 that is parallel to bottom 16 of opening 12. Pivotation members 34, 36 allow gate 20 to rest or lay substantially parallel and adjacent grade, proximately in front of opening 12 (FIGS. 1, 3, 6), for pivotation upwardly (FIG. 4) toward and across opening 12 (FIGS. 2, 5, 7).

A housing 38 for gate 20 and pivotation members 34, 36 includes a floor 40 and sides 42*a*, 42*b*, and end 42*c* apposite base 22 for containing gate 20 above floor 40 such that, with gate 20 resident in housing 38, front 28 of gate 20 substantially closes or covers gate housing 38 (see FIGS. 1, 3, 6), suitably not covering a surface water portal into the housing in the form of a grate 44 giving surface water access to floor 40 of housing 38 when gate 20 is resident in housing 38 (FIG. 3). The portal may be located elsewhere with an inlet into a sidewall or the floor 40 of housing 38, in which case, a substantial closing of the gate housing would extend to the end walls of housing 38. Housing 38 and gate 20 are configured to permit surface water entering through portal 44 to rise beneath gate 20 and pivotingly buoy gate 20 upwardly from housing 38 for rotation about pin axis 36 toward opening 12 (FIGS. 2, 3). In the embodiment, support members 32*a*–32*e* project from the back 29 of gate 20 (FIG. 7), and serve both to support gate 20 above the floor pan 40 of housing 38 and to provide channels adjacent support members 32*a*–32*e* through which water entering from portal 44 can flow under gate 20. Alternatively, ribs of a height sufficient to span the separation of back 29 to floor 40 and support gate 20 horizontally above floor 40 may be constructed on floor pan 40 instead of members 32*a*–32*e* being affixed to back 29 of gate 20, and be spaced to provide access for water to run under back 29 of gate 20. Or floor 40 may be deeper with flanges on opposing or all sides of the housing for support of a grate over floor 40 on which buoyant gate 20 may rest within housing 38. Other configurations will be apparent to those skilled in the art based on the concepts disclosed herein. Portal 44 is suitably located in housing 38 at the end or head of the housing remote from where base 22 of gate 20 is pivoted, i.e., near where top 26 of gate 20 resides when gate 20 lays in housing 38, as shown.

A pair of upright right triangular walls 48*a*, 48*b* reach from grade 46 and extend parallel alongside sides 24*a*, 24*b* of gate 20 at rest resident in housing 38 and hence alongside sides 39*a*, 39*b* of housing 38. The altitude of the right triangular shaped walls 48*a*, 48*b* is adjacent opening 12. Walls 48*a*, 48*b* have facing surfaces 49*a*, 49*b*. Surfaces 49*a*, 49*b* are spaced apart from one another sufficiently to allow gate 20 to pivot upwardly between walls 48*a*, 48*b* toward opening 12. Sides 24*a*, 24*b* of gate 20 are close enough to respective facing wall surfaces 49*a*, 49*b* to permit hydrostatic pressure of surface water 48 rising from grade 46 to develop against back 29 of gate 20 effective to impart a closing force (FIG. 4) on gate 20 after gate 20 buoyantly has pivoted from residence (FIG. 3) upwardly about pin axis 36.

Jambs 50*a*, 50*b* adjacent sides 18*a*, 18*b* of opening 12 confront and stop rotation of gate 20 about axis 36 when gate 20 is rotated a predetermined extent under the closing force of hydrostatic pressure of rising water 52 (FIG. 5), putting gate 20 in a closed position that refuses admission of rising water to at least a lower portion of opening 12. Jambs 50*a*, 50*b* suitably are L-shaped flanges fixed to walls 48*a*, 48*b*. The mentioned predetermined extent of upwardly permitted rotation suitably but not necessarily is an extent that places the jambs substantially upright but not in excess of 90 degrees relative to grade 46. If the jambs are less than vertical to a horizontal grade 46, and if no mechanism is provided to hold gate 20 raised, then, as flood waters recede, gate 20 will automatically lower itself. A vertical disposition is preferred for the simple reason that it provides a little more height against rising water. FIG. 6 and FIGS. 1–5 and 9–11 disclose a flood guard in which the jambs 50*a*, 50*b* are vertically arranged. FIG. 7 shows a variant of FIG. 6 in which jambs 50*a*, 50*b* (only 50*b* is visible) are slightly less than vertical. In the case of a vertical disposition, a mechanism is advantageously provided as a safety factor to prevent unmanaged lowering of gate 20, since, with a vertical disposition, there is no vertical gravitational vector acting on front 28 of gate 20 and gate 20 therefore is not predisposed to automatically lower as water recedes, as would a less than vertically disposed gate. A suitable safety mechanism is a latch 55 pivoting on pin 53 with a cam frontal surface 56 that slides over the top edge 29 of the rising gate 20 until the gate is pushed by rising water under notch 57 of the latch, whereupon the latch falls over the edge, fastening gate 20 to the vertical position.

Seals 58*a*, 58*b* advantageously are affixed to sides 24*a*, 24*b* of gate 20 to sealingly close gaps between sides 24*a*, 24*b* and facing wall surfaces 49*a*, 49*b* during rotation of gate 20 toward opening 12. Suitably seals 58*a*, 58*b* are contact seals that compress when brought into engagement with the surfaces 49*a*, 49*b* of walls 48*a*, 48*b* during rotation toward opening 12.

Figure 6:
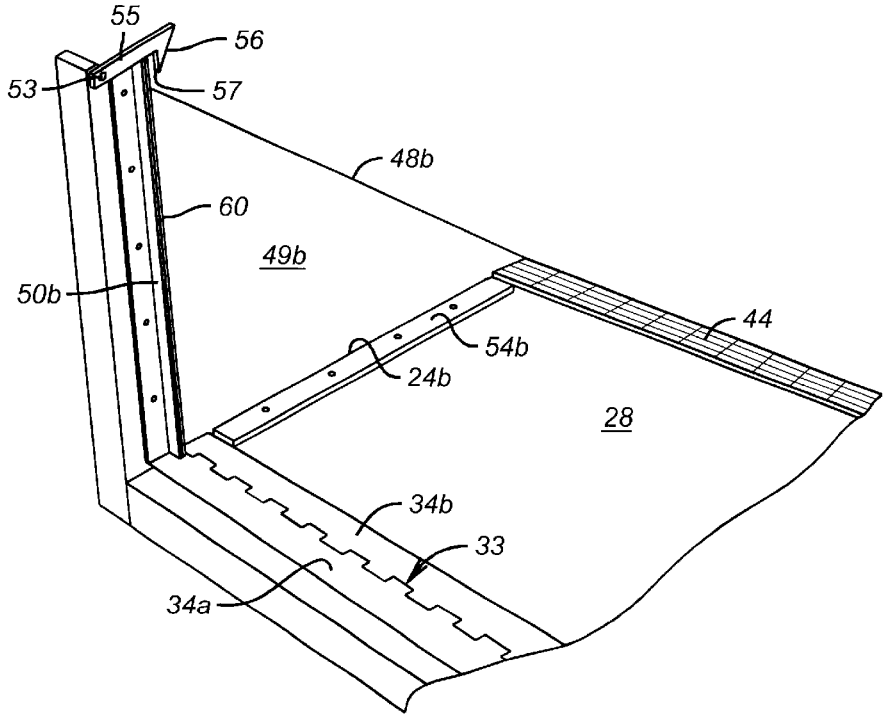
FIG. 6 is a perspective view of a portion of an embodiment of this invention with the gate resident in the gate housing, the view being toward the front of the gate left obliquely from a position that would be inside an imagined opening the embodiment would protect.
Figure 7:
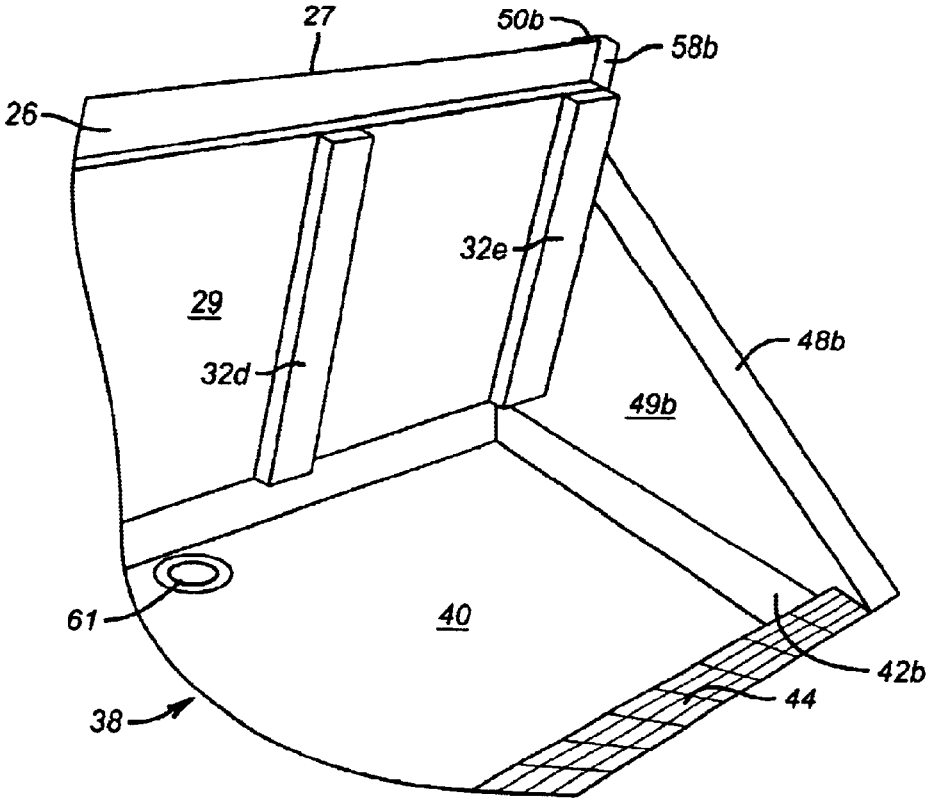
FIG. 7 is a perspective view of a portion of the embodiment of this invention variant slightly from that depicted in FIG. 6, with the gate rotated out of the gate housing, the view being toward the back of the gate obliquely from a position that would be outside an imagined opening the embodiment would protect, looking toward the imagined opening.
Figure 8:
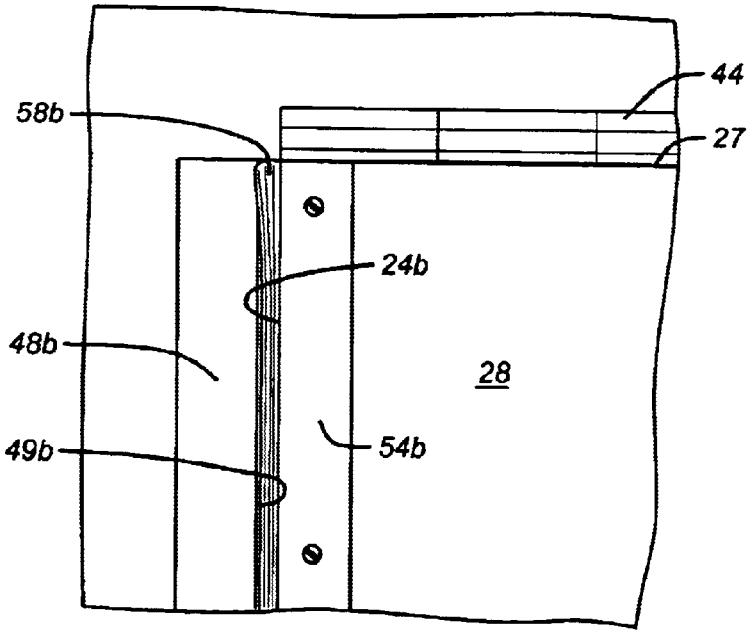
FIG. 8 is a view of a left portion of the gate of the embodiment of FIG. 6 in rising position, the view being frontally toward the front of the gate from a position that would be inside and at a raised elevation (eye level) of an imagined opening the embodiment would protect.

Referring particularly to FIGS. 6–8, an embodiment of the gate system is shown on pertinent part. In FIG. 6, gate 20 is resident in housing 38. In FIG. 7, gate 20 is rising from housing 38 toward closure against jambs 50*a*, 50*b*. Seal 58*b* (FIG. 8) is shown affixed to side 24*b* under a retaining strip 54*b* fastened to front 28 of gate 20. Seal 58*b* is compressed where the seal presses against wall 48*b*. This provides a water tight barrier while rising water is driving gate 20 to the closing position fixed by jambs 50*a*, 50*b*. As seen in FIGS. 7 and 8, the flotation compartment comprising back 29 of gate 20 in the embodiment of FIGS. 6, 7 and 8 does not extend to the full height of the front 28 of gate 20 (although it may), in this instance providing a lip at the top 26 over which latch 55 may ride to secure gate 20 closed in the raised position after waters recede.

In the embodiment of FIGS. 1–11, jambs 50*a*, 50*b* are affixed to walls 48*a*, 48*b* adjacent opening 12 and reach upwardly from adjacent grade 46. Jambs 50*a*, 50 reach an elevation proximate the height of the upright walls 48*a*, 48*b* adjacent the opening. As seen in FIG. 6, the reach is substantially coincident with the height of wall 48*b* at the location of wall 48*b* to which jamb 50*b* is affixed.

Jambs 50*a*, 50*b* suitably include a resilient sealing surface 60 (see FIG. 6) arranged to cooperate with facing surfaces of the front of the gate in the closed position to seal against admission of water between jambs 50*a*, 50*b* and gate 20. In the embodiment of FIGS. 6–8, the facing surface is retaining strip 54*b*(shown) and 54*a* (not viewable).

As seen in the embodiment of FIGS. 3–6 and 7, housing 38 suitably includes a outlet 61 leading to a drain tube 67 at an end of housing 20 opposite portal 40. The outlet 61 and drain tube 67 allows removal of water from housing 38 when waters entering portal 40 other than in a flooding condition, as explained above.

In the embodiment of FIGS. 6–8, the flood guard system is an integral package or unit that can be installed by making a shallow excavation at the entrance to an opening of the construction to be protected and fixedly setting the unit in place. The unit can be used where the grade is horizontal, as shown, or is downwardly sloped.

In accordance with the invention, the walls 48 alternatively may extend from the construction 14 (FIGS. 1, 2). In such configuration, the walls 48 in cooperation with the jambs 50 and the gate 20 in its closed position (FIG. 2) are a barrage to water between walls 48 and construction 14. Alternatively also, the jambs 50 may be affixed to the construction 14 directly adjacent (including on) the sides 18 of the opening 12. In that case, the jambs 50 in cooperation with the gate 20 in closed position are a barrage to water between the jambs 50 and the construction 14.

Figure 9:
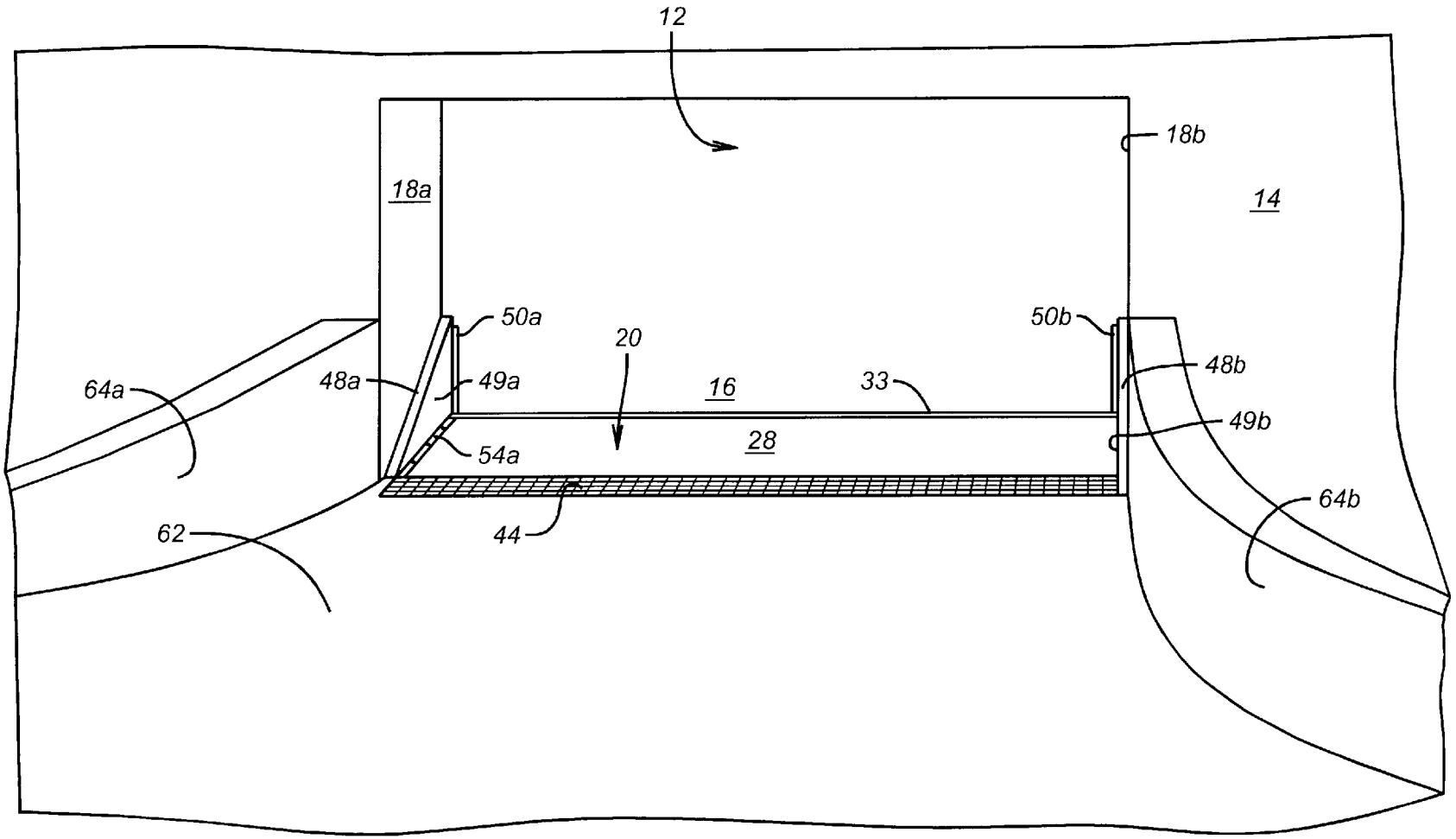
FIG. 9 is a perspective view of a gate of this invention installed guarding the entrance to an underground parking garage, with the gate lowered and resident in a gate housing.

Referring to FIG. 9, a flood guard of this invention is depicted installed in an opening 12 of an underground parking garage 14 approached by a downwardly sloped ramp 62 bulwarked at the sides from earth invasion by entrance wall structures 64*a*, 64*b*. Walls 48*a*, 48*b* abut immediately against the sides 18*a*, 18*b* of opening 12.

Figure 10:
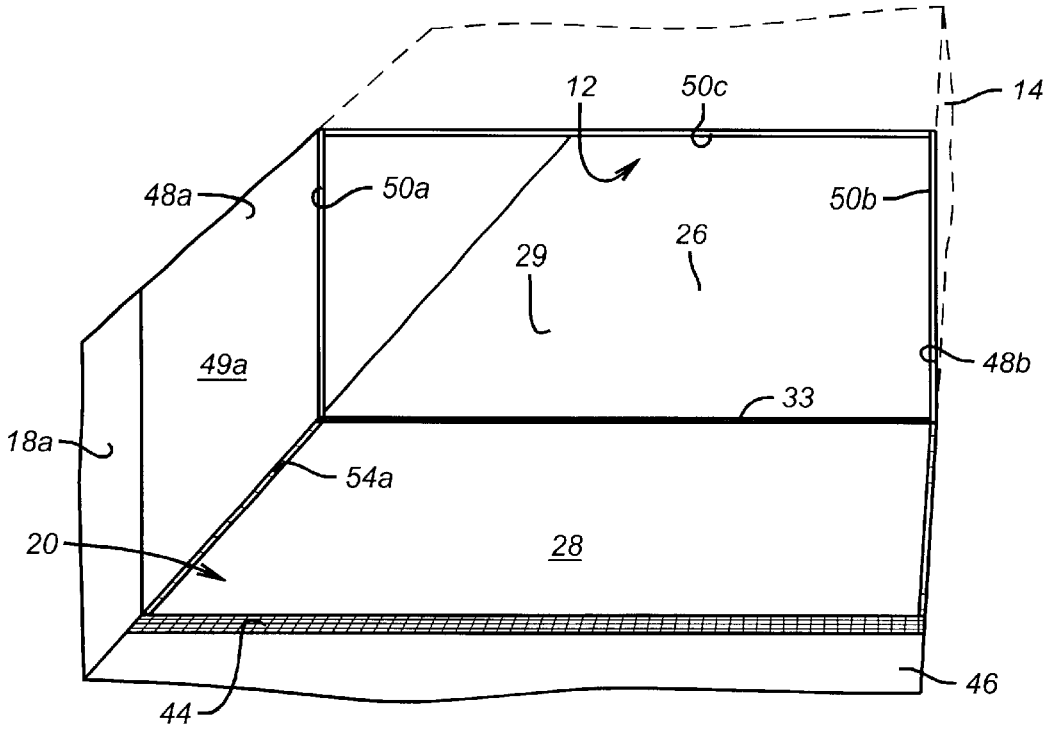
FIG. 10 is a perspective view of a gate of this invention installed guarding a passageway of an underground tunnel, with the gate lowered and resident in a gate housing.
Figure 11:
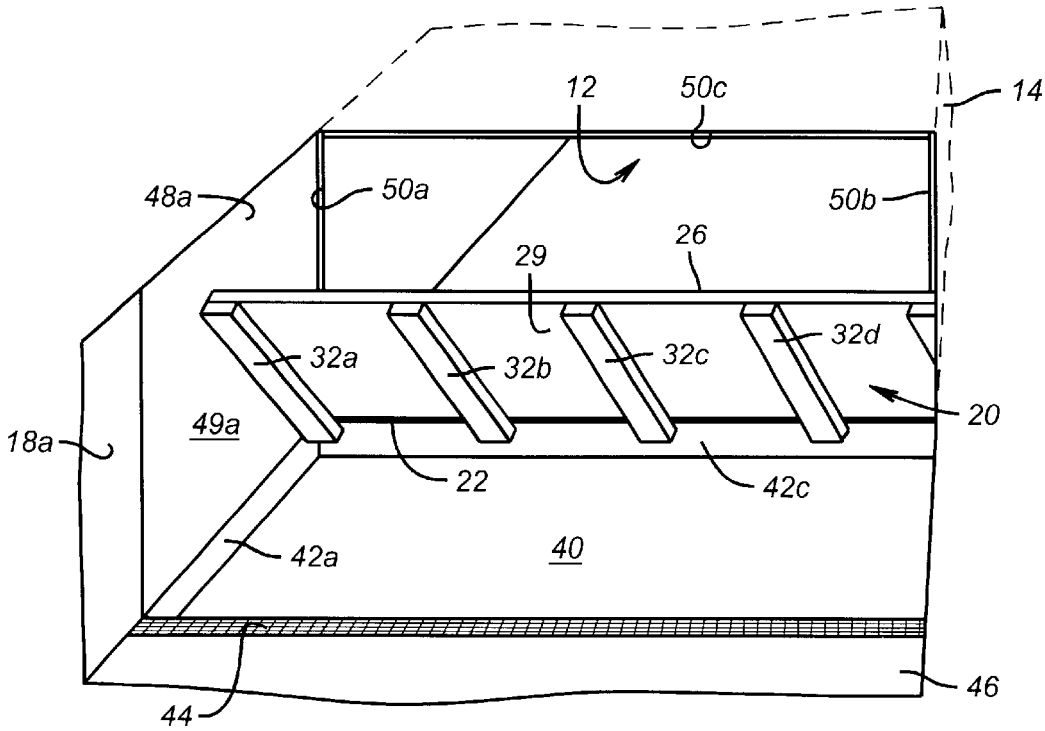
FIG. 11 is a perspective view from the same position as FIG. 10 showing the flood gate rising to guard the passage as it would under the force of waters flooding into the tunnel.

Referring to FIGS. 10 and 11, a flood guard of this invention is depicted installed in an opening of an underground pedestrian tunnel. The underground tunnel may be finished with attractive surfaces. Walls 48*a*, 48*b* minimally may have the right triangular shape such as depicted in FIGS. 1–9 for the reasons already stated, but may have any contour beyond the minimum of the hypotenuse of the triangle that is considered decorative. As shown in FIGS. 10–11, this is a rectangular shape, and suitably may be polished granite or other water impervious surface. In FIGS. 10–11, the portion of the walls of the tunnel leading up to walls 48*a*, 48*b* are flush with walls 48*a*, 48*b*. In addition to lateral jambs 50*a*, 50*b*, and over head jamb 50*c* is provided above opening 12, and as in embodiments 1–9, jambs 50*a*–50*c* suitably are faced with a resilient sealing material to resist leakage. The hydraulic pressure of water pressing against the resilient material is sufficient to forestall any significant leakage. A safety latch 55 is also suitably present (not shown in FIGS. 10–11).

In operation of the invention, referring to FIGS. 3–5, gate 20, of dimension occlusive to at least a lower portion of opening 12 and resident in recessed housing 38 adjacently in front of opening 12, substantially parallel to grade 46, admits surface water 52 into the housing recess through ports 44 (FIG. 3). Rise of water in the recess causes gate 20 to buoy upwardly from said recess pivoting on pivotation pin 36 in a rotation closing towards opening 12 (FIG. 4). Walls 48 wiped by compression seals 50 projecting from the sides 24 of gate 20 prevent rising surface water 52 from flowing around sides 24 of upwardly buoyed gate 20 between sides 24 and walls 48. Rising surface water 52 accumulates behind gate 20 and hydraulic pressure of the water imparts a closing force rotating gate 20 toward, thence occlusively across, at least a lower portion of opening 12 (FIG. 5).

There is thus provided a method that comprises (a) housing a buoyant gate 20 occlusive of least a lower portion of the opening 12 adjacently in front 16 of opening 12, substantially parallel to grade 46, in a recess 38 into which surface water 52 can flow, such that gate 20 housed in recess 38 provides a weigh bearing passageway on its front side 28 to opening 12, (b) pivoting gate 20 about a pivot axis 36 parallel to the bottom 16 of opening 12 to allow gate 20 to pivot upwardly towards and across opening 12 from recess 38, and (c) preventing rising surface water 52 from flowing around sides 24*a*, 24*b* of gate 20, such that, on admission of surface water 54 into recess 38, gate 20 pivotingly buoys upwardly from recess 38 in a rotation towards opening 12, accumulating rising surface water 52 behind gate 20, whereby hydraulic pressure exerts force rotation of gate 20 toward, thence occlusively across, at least a lower portion of opening 12.

The phrase "at least a lower portion" of opening 12 is intended to convey the meaning that gate 20 may be of dimension to close the entirety of an opening before which it is placed. Thus, the gate may entirely close the opening, as in FIGS. 10–11.

Having described the invention both generally, schematically and in connection with a preferred embodiment, those skilled in the art will perceive variations of the invention which although not the same as those described herein will be within the scope and spirit of the claims, which now follow.

I claim:

1. A self-actuating flood guard system for refusing admission of rising surface water into a structural opening of a construction, the opening having opening limiting margins including a bottom, said system comprising:

a buoyant gate having a base, sides, a front, a back and dimensions occlusive of at least a lower portion of said opening, said base being arranged for location adjacent said bottom of said opening, pivotation members hinging said gate at said base about a pivot axis parallel to said bottom of said opening and allowing said gate to rest substantially parallel and adjacent grade proximately in front of said opening for pivotation upwardly toward and transversely to said opening, a pair of upright walls reaching from grade and extending alongside said sides of said gate at rest, said walls having facing surfaces spaced apart sufficiently to allow the gate to pivot upwardly between them toward said opening with the sides of said gate close enough to the facing wall surfaces to permit hydrostatic pressure of surface water rising from said grade to develop against the back of the gate effective to impart a closing force on the gate after the gate buoyantly has pivoted from rest upwardly about said axis, and jambs adjacent at least side margins of said opening for confronting and stopping rotation of said gate about said axis when said gate is rotated a predetermined extent under said closing force of said rising water hydrostatic pressure, thereby putting said gate in a closed position refusing admission of rising water into at least a lower portion of said opening.

2. The system of claim 1 further comprising a housing for said gate and pivotation members, said housing including a floor and sides for containing said gate above said floor such that with the gate resident in the housing the front of the gate substantially closes the gate housing.

3. The system of claim 2 in which said gate is weight bearing and resident in said housing provides a passageway for traffic into said construction through said opening.

4. The system of claim 2 wherein said gate housing further comprises a surface water portal into said housing giving access to said floor of the housing when said gate is resident in said housing, said housing and gate being configured to permit surface water entering through said portal to rise beneath said gate and pivotingly buoy said gate upwardly from the housing for rotation about said axis toward said opening.

5. The system of claim 4 in which said portal is located in said housing remote from said base.

6. The system of claim 4 in which said housing contains a drain for connection to a storm water collection tributary.

7. The system of claim 1 further comprising seals affixed to the sides of the gate for sealingly closing gaps between said sides of said gate and said facing wall surfaces.

8. The system of claim 7 in which the seals are contact seals.

9. The system of claim 8 in which said contact seals compress upon engagement with said walls.

10. The system of claim 1 in which said jambs are affixed to said upright walls adjacent said opening.

11. The system of claim 10 in which said jambs reach upwardly from adjacent grade.

12. The system of claim 11 in which said jambs reach an elevation proximate the height of said upright walls adjacent said opening.

13. The system of claim 11 in which said predetermined extent is an extent that places said jambs vertically.

14. The system of claim 13 further comprising a safety latch for engaging said gate as the gate proximately approaches said jambs and for latching said gate when said gate is against said jambs.

15. The system of claim 1 in which said jambs include a resilient sealing surface arranged to cooperate with facing surfaces of the front of said gate in said closed position to seal against admission of water between said jamb and said gate.

16. The system of claim 1 in which said gate comprises buoyant material sandwiched between two rigid panels.

17. The system of claim 1 in which said gate comprises a plurality of sealed tubes arranged side by side.

18. The system of claim 17 in which said gate further comprises a plurality of structural supports spaced apart on the back side of said gate.

19. The system of claim 16 in which said gate comprises a honeycomb core structure sealingly arranged between two rigid panels.

20. The system of claim 16 in which said gate comprises a bladder arranged between two rigid panels.

21. The system of claim 1 in which said jambs are affixed to said construction on said side margins of said opening.

22. The system of claim 21 in which said jambs in cooperation with said gate in said closed position are a barrage to water between said jambs and said construction.

23. The system of claim 1 in which said upright walls extend from said construction and in cooperation with said jambs and said gate in said closed position are a barrage to water between said walls and said construction.

24. The system of claim 1 in which said upright walls have the shape of a right triangle with the base of the triangle adjacent and parallel to said sides of said gate and the altitude of the triangle adjacent said opening.

25. The system in claim 1 in which said grade is horizontal.

26. The system of claim 1 in which said grade is angled relative to horizontal.

27. The system of claim 1 in which said construction is an underground parking garage.

28. The system of claim 1 in which said construction is an underground tunnel, wherein said limiting margins include a top margin, and wherein said jambs include a jamb at the top margin, said jambs including a resilient sealing surface arranged to cooperate with facing surfaces of the front of said gate in said closed position to seal against admission of water between said jambs and said gate.

29. A self-actuating flood guard system for refusing admission of rising surface water into a structural opening of a construction, the opening having opening limiting margins including a bottom, said system comprising:

a buoyant gate having a base, sides, a front, a back and dimensions occlusive of at least a lower portion of said opening, said base being arranged for location adjacent said bottom of said opening, pivotation members hinging said gate at said base about a pivot axis parallel to said bottom of said opening and allowing said gate to rest substantially parallel and adjacent grade proximately in front of said opening for pivotation upwardly toward and transversely to said opening, a housing for said gate and pivotation members, said housing including a floor and sides for containing said gate above said floor such that with the gate resident in the housing the front of the gate substantially closes the gate housing, a surface water portal into said housing giving access to said floor of the housing when said gate is resident in said housing, said housing and gate being configured to permit surface water entering through said portal to rise beneath said gate and pivotingly buoy said gate upwardly from the housing for rotation about said axis toward said opening, a pair of upright walls reaching from grade and extending alongside said sides of said gate at rest, said walls having facing surfaces spaced apart sufficiently to allow the gate to pivot upwardly between them toward said opening with the sides of said gate close enough to the facing wall surfaces to permit hydrostatic pressure of surface water rising from said grade to develop against the back of the gate effective to impart a closing force on the gate after the gate buoyantly has pivoted from rest upwardly about said axis, seals affixed to the sides of said gate for sealingly closing gaps between said sides of said gate and said facing wall surfaces, and jambs adjacent at least sides margins of said opening for confronting and stopping rotation of said gate about said axis when said gate is rotated a predetermined extent under said closing force of said rising water hydrostatic pressure, thereby putting said gate in a closed position refusing admission of rising water into at least a lower portion of said opening, said jambs including a resilient sealing surface arranged to cooperate with the front of said gate in said closed position to seal against admission of water between said jamb and said gate.

30. The system of claim 29 in which said jambs are affixed to said upright walls adjacent said opening and reach upwardly from adjacent grade.

31. The system of claim 30 in which said predetermined extent is an extent that places said jambs substantially upright relative to said grade.

32. The system of claim 29 in which said housing contains a drain for connection to a storm water collection tributary.

33. A self-actuating flood barrier system for a structural opening of a construction, the opening having a opening limiting margins, including a bottom, said system comprising a weight bearing buoyant gate having a base, front, back, and sides, said gate being rotatable about a pivot axis at the base of the gate generally parallel to the bottom of said opening and comprising a plurality of sealed tubes arranged side by side, a gate housing outside said construction in front of said bottom of said opening at an elevation below the bottom of the opening and arranged generally parallel to grade in front of said opening, said housing having a floor and sides and being configured to pivotingly receive and support said gate above said floor parallel to said grade such that the front of said gate substantially closes the housing, said gate resident in said housing providing a passageway for traffic into said construction through said opening a portal into said housing to admit surface water into said housing beneath said gate for pivotingly displacing said buoyant gate upwardly from the housing in rotation toward said opening, a pair of walls raised adjacent said construction alongside said sides of said housing, said walls having facing substantially planar surfaces spaced apart sufficiently to allow the gate to pivotally swing upwardly between them toward said opening with the sides of said gate close enough to the facing surfaces of the walls to create hydrostatic pressure on the gate effective to close the gate during rise of surface water after the gate buoyantly has pivoted upwardly about said axis from said housing, and jambs extending upwardly from said grade adjacent said the opening substantially upright to grade and spaced apart not greater than the opposing surfaces of said walls, having surfaces for engaging corresponding portions of said gate front under impress of the force of hydraulic pressure acting on said back of said gate after said gate is rotated upwardly between said wall panels by rising water.

34. The system of claim 33 further comprising contact compression seals affixed to the sides of the gate for sealingly closing the gaps between said sides of said gate and said facing wall surfaces.

35. The system of claim 33 in which said jambs are affixed to said upright walls adjacent said opening, reach upwardly from adjacent grade, and include a resilient sealing surface arranged to cooperate with facing surfaces of the front of said gate in said closed position to seal against admission of water between said jamb and said gate.

36. The system of claim 33 in which said housing contains a drain for connection to a storm water collection tributary.

37. A method for automatically refusing admission of rising surface water into a structural opening of a construction, the opening having opening limiting margins, including a bottom, said method comprising:

housing a buoyant gate of dimension occlusive to at least a lower portion of said opening adjacently in front of said opening, substantially parallel to grade, pivotingly arranged about a pivot axis parallel to said bottom of said opening and in a recess into which surface water can flow, providing a portal for admitting surface water into said recess to cause the gate to pivotingly buoy upwardly from said recess in a rotation closing towards said opening, and preventing rising surface water from flowing around sides of the upwardly buoyed gate, whereby rising surface water accumulates behind the gate and hydraulic pressure of the rising surface water exerts a continuing closing force rotating the gate toward, thence occlusively across, at least a lower portion of said opening.

38. A method for automatically refusing admission of rising surface water into a structural opening of a construction, the opening having open limiting margins, including a bottom, said method comprising:

housing a buoyant gate occlusive of least a lower portion of said opening adjacently in front of said opening, substantially parallel to grade, in a recess into which surface water can flow, such that the gate housed in the recess provides a weight bearing passageway to said opening, pivoting said gate about a pivot axis parallel to said bottom of said opening to allow said gate to pivot upwardly towards and across said opening from said recess, and preventing rising surface water from flowing around sides of the gate such that, on admission of surface water into said recess, the gate pivotingly buoys upwardly from said recess in a rotation towards said opening, accumulating rising surface water behind the gate, whereby hydraulic pressure exerts force rotation of the gate toward, thence occlusively across at least a lower portion of the opening.

* * * * *